US006953040B2

(12) United States Patent
Atchley et al.

(10) Patent No.: US 6,953,040 B2
(45) Date of Patent: Oct. 11, 2005

(54) TOBACCO MINT PLANT MATERIAL PRODUCT

(75) Inventors: Frank S. Atchley, Nashville, TN (US); Vernie A. Due, Nashville, TN (US); Thomas R. Gray, Murfreesboro, TN (US)

(73) Assignee: U.S. Smokeless Tobacco Company, Greenwich, CT (US)

( * ) Notice: Subject to any disclaimer, the term of this patent is extended or adjusted under 35 U.S.C. 154(b) by 25 days.

(21) Appl. No.: 10/256,118

(22) Filed: Sep. 26, 2002

(65) Prior Publication Data

US 2003/0094182 A1 May 22, 2003

Related U.S. Application Data

(60) Provisional application No. 60/325,507, filed on Sep. 28, 2001.

(51) Int. Cl.[7] ..... A24B 15/00

(52) U.S. Cl. ..... 131/352; 131/359

(58) Field of Search ..... 131/359, 352, 131/347

(56) References Cited

U.S. PATENT DOCUMENTS

| | | | | |
|---|---|---|---|---|
| 2,930,719 A | * | 3/1960 | Finberg | 131/335 |
| 3,067,068 A | * | 12/1962 | Finberg | 131/359 |
| 4,620,554 A | | 11/1986 | Horimoto | |
| 4,696,315 A | | 9/1987 | Summers | |
| 4,817,640 A | | 4/1989 | Summers | |
| 5,513,663 A | | 5/1996 | Van Leuven et al. | |
| 5,944,026 A | | 8/1999 | Kopsch et al. | |

* cited by examiner

*Primary Examiner*—Dionne A. Walls
(74) *Attorney, Agent, or Firm*—Fitch, Even, Tabin & Flannery

(57) ABSTRACT

The present invention is directed to smokeless tobacco compositions, such as a chewing tobacco and/or snuff composition comprising tobacco and mint plant material, where the mint plant material is mint leaf with or without endogenous mint oil, mint stems, and the like.

24 Claims, No Drawings

TOBACCO MINT PLANT MATERIAL PRODUCT

This application claims the benefit under 35 USC 119(e) of U.S. provisional application No. 60/325,507 filed Sep. 28, 2001.

The present invention relates to tobacco compositions, more specifically smokeless tobacco compositions that are comprised of tobacco and mint plant material. More particularly, the composition is comprised of a mixture of tobacco and mint plant material including mint leaves, said leaves being with or without their endogenous mint oil, mint stems with or without their endogenous mint oil, and the like. Mixtures of mint plant material and tobacco are blended in amounts effective for minimizing the negative flavor attributes sometimes found in tobacco.

BACKGROUND

Smokeless tobaccos are products that are orally consumed without subjecting the product to combustion. These products are manufactured in a variety of forms including chewing tobacco, dry snuff and moist snuff. Generally, these types of products are made as follows with the steps being in no particular order: cutting or grinding the tobacco into a suitable size; dipping or spraying the tobacco with a casing solution; partially drying the cased tobacco; holding the tobacco in containers for a period of time; and packaging it.

Chewing tobacco is typically sold in one of three forms: a "plug" where the tobacco is compressed into one of any number of shapes; "twists", where leaves are entwined into a rope-shaped product; and loose, leafy chewing tobacco where it is presented in an envelop-like container. Plugs typically have a moisture content around 15% or less by volume for "hard" plugs and greater than 15% for "soft" plugs. Twists and loose, leafy material are typically lower in moisture.

As stated previously, snuffs typically are marketed as either "dry" or "moist". Dry snuffs are generally finely ground, almost powdery, and typically have moisture contents around 8%. Moist snuffs, which typically have about 40 to 60% moisture content can have a variety of particle sizes depending on the product.

Chewing tobacco and snuffs are often treated with a variety of flavors to help diminish some of the less desired taste characteristics sometimes associated with the tobacco base. For example, oral use of tobacco typically induces the production of saliva and the resulting "tobacco juice" can sometimes have an unpleasant bitter taste. Flavors are often added to overcome these taste characteristics. Accordingly, a need exists in the market place for a smokeless tobacco-based product that can provide oral tobacco satisfaction while diminishing or eliminating the less desired taste characteristics sometimes associated therewith.

SUMMARY

The present invention is directed to smokeless tobacco compositions, such as a chewing and/or snuff composition comprising tobacco and mint plant material, where the mint plant material is mint leaf with or without endogenous mint oil, mint stems with or without endogenous mint oil, and the like. The combination of tobacco and mint plant material provides a smokeless product that when chewed provides a sensation and pleasure associated with oral tobaccos while diminishing less desired characteristics sometimes associated therewith. Furthermore, the addition of mint plant material causes a synergistic diminishment of these characteristic beyond that normally expected or observed upon adding equal amounts of exogenous mint oil instead of the mint plant material.

In an important aspect, the mixture of tobacco and mint plant material is effective for minimizing less-desired flavor attributes in chewing tobacco. Further, the tobacco and mint plant material mixture allows the user to chew or dip the composition while reducing the negative taste sensations experienced sometimes with conventional tobacco products.

The tobacco product of the present invention is a blend of more than about 7.5 weight percent tobacco and less than about 92.5 weight percent mint plant material, based on the total weight of the tobacco and mint plant material mixture. The mint plant material may include mint leaves with or without endogenous mint oil, mint stems with or without endogenous mint oil, and mixtures thereof. In an important aspect of the invention the tobacco product includes from about 7.5 weight percent to about 20 weight percent mint plant material, in another aspect from about 20 weight percent to about 40 weight percent mint plant material, in another aspect from about 40 weight percent to about 60 weight percent mint plant material, in another aspect from about 60 weight percent to about 90 weight percent mint plant material, and in another aspect from about 40 weight percent to about 50 weight percent mint plant material, all based on the total weight of the tobacco and mint plant material in the mixture.

In an important aspect, the present invention provides a chewing tobacco and/or snuff composition comprising tobacco and mint plant material in an amount effective for providing a preferred product as compared to a product that does not include mint plant material, or has the mint plant material replaced with a cellulose/mint oil composition or any other combination that includes exogenous or added mint oil.

DETAILED DESCRIPTION

The composition of the present invention is a blend of mint plant material and tobacco. The tobacco and mint plant material are blended in an amount effective for providing a product that does not have some of the negative flavor characteristics sometimes associated with tobacco. "Negative flavor characteristics" refers to bitterness, astringency, acridness, harsh tobacco flavor, aftertaste, negative sensations experienced in the throat or stomach, and the like. Definitions of flavor characteristics are provided in The Dictionary of Flavors, DeRovira, Food & Nutrition Press, Inc., 1999, which is incorporated herein by reference.

In an important aspect of the invention, the mint plant material is effective for allowing a user of the product to chew or dip the tobacco while reducing the negative flavor characteristics sometimes associated with oral tobacco use as compared to compositions that do not include mint plant material.

In another important aspect, the compositions are improved without added mint oil. As used herein, "added mint oil" refers to mint oil that has already been processed and is in a form that is substantially free of mint plant material such as leaves, stems and roots. These types of mint oils are sometimes added to and blended with tobacco.

In an important aspect, the blend of the present invention may include the following ranges of mint plant material and tobacco.

| Weight % Mint Plant Material | Weight % Tobacco |
|---|---|
| 92.5 | 7.5 |
| 90.0 | 10.0 |
| 85.0 | 15.0 |
| 80.0 | 20.0 |
| 75.0 | 25.0 |
| 70.0 | 30.0 |
| 65.0 | 35.0 |
| 60.0 | 40.0 |
| 55.0 | 45.0 |
| 50.0 | 50.0 |
| 45.0 | 55.0 |
| 40.0 | 60.0 |
| 35.0 | 65.0 |
| 30.0 | 70.0 |
| 25.0 | 75.0 |
| 20.0 | 80.0 |
| 15.0 | 85.0 |
| 10.0 | 90.0 |
| 5.0 | 95.0 |

Mint Plant Material

In an important aspect, the present invention includes mint plant materials. As used herein "mint plant materials" refers to plants of the genus *Mentha*. The genus *Mentha* includes but is not limited to those listed in the USDA, ARS, National Genetic Resources Program, Germplasm Resources Information Network—(GRIN), National Germplasm Resources Laboratory, Beltsville, Md. (www.ars-grin.gov/var/apache/cgi-bin/npgs/html/tax/taxlist.pl?*Mentha*). Examples of *Mentha aquatica, Mentha canadensis, Mentha cervina, Mentha japonica, Mentha logifolia, Mentha piperita, Mentha pulegium, Mentha spicata*, and *Mentha suaveolens.*

The mint plant materials of the present invention may include mint leaf, mint stems and the like. All of the mint plant materials may include an amount of mint oil that naturally occurs or is endogenous in the plant. Further, mint plant materials may include mint plant materials where some amount of the mint oil has been removed. The mint plant material may be mint leaf alone, mint stems alone, or a combination of mint leaf and mint stems either with or without the endogenous oils contained therein.

Tobacco

In an important aspect, the tobacco used in the product of the present invention may be any tobacco known to be suitable for use as chewing tobacco or snuffs. Suitable tobaccos include fermented and unfermented tobaccos, air cured, burley, dark, dark-fired, flue cured, and cigar filler or wrapper as well as the products from the whole leaf stemming operation. Alternatives and variations include the use of tobacco leaf or lamina and stem. In addition, scrap size tobacco lamina may be commingled with homogenized product for the purpose of controlling the texture and flavor release during chewing or dipping.

The tobacco used in the present invention may be mixed with other additives as known in the chewing tobacco art. Hence, the tobacco percentages used herein may refer to tobacco alone or tobacco in combination with various known additives.

Production of Tobacco-Mint Plant Material Product

After choosing an appropriate tobacco type, the tobacco is chopped or ground to appropriate sizes depending on the type of product being made. The material may also be further separated based on size by passing it over a screen to size. Chopping or grinding of the tobacco may be accomplished using any methods known in the art for that purpose. Mint plant material may also be chopped or ground using similar methods.

Tobacco and mint plant material that have been appropriately chopped or ground are blended together using methods and equipment known in the art. Other known additives may be blended with the tobacco and/or the mint plant material either before or after the tobacco and mint plant material are blended together. Tobacco and mint plant material may be further processed separately before they are mixed together or further processed together after mixing.

The following examples illustrate methods for carrying out the invention and should be understood to be illustrative of, but not limiting upon, the scope of the invention which is defined in the appended claims.

EXAMPLES

Example I

Generic air cured tobacco was made from aged air cured leaf that was ground in a Whiley Mill using a 4 mm screen. The same exact setting were used to grind Madras mint leaf grown in the Pacific Northwest. Mint oil distilled from the same mint leaf material was also used in the placebo sample.

Oven volatiles were run on the tobacco and the mint leaf to determine moisture content of each. This was then used to calculate needed RO water amount to bring the blend to 30 percent moisture. A range of blends were made over the course of several weeks and submitted to an internal taste panel. The ranges were 5, 10, 15, 20, 40, 60, and 80 percent mint leaf. Each panelist received a paired set of the blended sample and the placebo of the respective percentage as it was blended and asked to evaluate within 2 days to eliminate any product age interferences.

The placebo composition was a respective percentage blend of tobacco and cellulose. The cellulose was washed, dried and compacted. The cellulose was used commercially as a flavor carrier. The specific characteristics of the cellulose were such that minimal flavor in introduced in to the mixture by the cellulose itself. The same level of mint oil found in the leaf was placed in the cellulose before blending to provide for as true as a placebo as possible in all aspects of flavor interaction and consistency.

During the blinded study, taste panels were asked to rate flavor characteristics such as bitterness, astringency, acridness, and tobacco aftertaste, and indicate their sample preference. A rating of 1 was considered poor as a rating of 10 was considered good. Results were as follows.

| | BITTERNESS | ASTRINGENCY | ACRIDNESS | TOBACCO | AFTERTASTE |
|---|---|---|---|---|---|
| | | | SAMPLE 20% Mint Leaf | | |
| AVG | 4.89 | 5.11 | 5.67 | 4.22 | 5.44 |
| PREFERENCE PERCENT 88.9% | | | | | |
| | | | SAMPLE 20% Placebo | | |
| AVG | 3.89 | 3.89 | 4.11 | 4.33 | 2.89 |
| PREFERENCE PERCENT 11.11% | | | | | |
| | | | SAMPLE 40% Mint Leaf | | |
| AVG | 5.00 | 5.43 | 4.79 | 4.71 | 5.79 |
| PREFERENCE PERCENT 71.43% | | | | | |
| | | | SAMPLE 40% Placebo | | |
| AVG | 3.57 | 4.14 | 2.79 | 4.79 | 4.21 |
| PREFERENCE PERCENT 28.57% | | | | | |
| | | | SAMPLE 60% Mint Leaf | | |
| AVG | 5.33 | 6.17 | 6.33 | 4.17 | 5.50 |
| PREFERENCE PERCENT 83.33% | | | | | |
| | | | SAMPLE 60% Placebo | | |
| AVG | 4.17 | 4.67 | 4.83 | 3.00 | 3.67 |
| PREFERENCE PERCENT 16.67% | | | | | |

| | PREFERENCE COMPARISON % Mint Leaf | | |
|---|---|---|---|
| | 60% | 40% | 20% |
| Mint Plant Material | 83.33% | 71.43% | 88.39% |
| Placebo | 16.67% | 28.57% | 11.11% |

Numerous modifications and variations in practice of the invention are expected to occur to those skilled in the art upon consideration of the foregoing detailed description of the invention. Consequently, such modifications and variations are intended to be included within the scope of the following claims.

What is claimed is:

1. A snuff composition comprising more than about 7.5 weight percent tobacco and less than about 92.5 weight percent mint plant material, based on the weight of the composition, wherein the mint plant material is a mixture of mint leaf and mint stems.

2. A snuff composition according to claim 1 wherein the composition includes from about 20 weight percent to about 40 weight percent mint plant material, based on the weight of the composition.

3. A snuff composition according to claim 1 wherein the composition includes from about 40 weight percent to about 60 weight percent mint plant material, based on the weight of the composition.

4. A snuff composition according to claim 1 wherein the composition includes from about 60 weight percent to about 90 weight percent mint plant material, based on the weight of the composition.

5. A snuff composition according to claim 1 wherein the composition includes from about 40 weight percent to about 50 weight percent mint plant material, based on the weight of the composition.

6. A snuff composition according to claim 1 wherein the mint plant material is from the genus *Mentha*.

7. A snuff composition according to claim 6 wherein the mint plant material is from *Mentha spicata*.

8. A snuff composition according to claim 6 wherein the mint plant material is from *Mentha piperita*.

9. A snuff composition according to claim 1 wherein the composition includes from about 5 weight percent to about 10 weight percent mint plant material, based on the weight of the composition.

10. A snuff composition according to claim 1 wherein the composition includes from about 10 weight percent to about 15 weight percent mint plant material, based on the weight of the composition.

11. A snuff composition according to claim 1 wherein the composition includes from about 15 weight percent to about 20 weight percent mint plant material, based on the weight of the composition.

12. A snuff composition according to claim 1 wherein the composition includes from about 60 weight percent to about 80 weight percent mint plant material, based on the weight of the composition.

13. A snuff composition comprising tobacco and mint plant material in an amount effective for reducing negative flavor attributes, the composition comprising more than about 7.5 weight percent tobacco and less than about 92.5 weight percent mint plant material, based on the weight of the composition, wherein the mint plant material is a mixture of mint leaf and mint stems.

14. A snuff composition according to claim 13 wherein the composition includes from about 20 to about 40 weight percent mint plant material, based on the weight of the composition.

15. A snuff composition according to claim 13 wherein the composition includes from about 40 weight percent to about 60 weight percent mint plant material, based on the weight of the composition.

16. A snuff composition according to claim 13 wherein the composition includes from about 60 weight percent to about 90 weight percent mint plant material, based on the weight of the composition.

17. A snuff composition according to claim 13 wherein the composition includes from about 40 weight percent to about 50 weight percent mint plant material, based on the weight of the composition.

18. A snuff composition according to claim 13 wherein the mint plant material is from the genus *Mentha*.

19. A snuff composition according to claim 18 wherein the mint plant material is from *Mentha spicata*.

20. A snuff composition according to claim 18 wherein the mint plant material is from *Mentha piperita*.

21. A snuff composition according to claim 13 wherein the composition includes from about 7.5 weight percent to about 10 weight percent mint plant material, based on the weight of the composition.

22. A snuff composition according to claim 13 wherein the composition includes from about 10 weight percent to about 15 weight percent mint plant material, based on the weight of the composition.

23. A snuff composition according to claim 13 wherein the composition includes from about 15 weight percent to about 20 weight percent mint plant material, based on the weight of the composition.

24. A snuff composition according to claim 13 wherein the composition includes from about 60 weight percent to about 80 weight percent mint plant material, based on the weight of the composition.

* * * * *